US009985394B2

(12) United States Patent
Atkinson et al.

(10) Patent No.: US 9,985,394 B2
(45) Date of Patent: May 29, 2018

(54) POLARITY CONTROL FOR A FLAT CONNECTOR

(71) Applicant: HEWLETT-PACKARD DEVELOPMENT COMPANY, L.P., Houston, TX (US)

(72) Inventors: Lee Warren Atkinson, Taipei (TW); James M. Mann, Cypress, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

(21) Appl. No.: 15/409,059

(22) Filed: Jan. 18, 2017

(65) Prior Publication Data

US 2017/0125953 A1 May 4, 2017

Related U.S. Application Data

(63) Continuation of application No. 14/434,177, filed as application No. PCT/US2012/060767 on Oct. 18, 2012, now Pat. No. 9,583,893.

(51) Int. Cl.
*H01R 13/66* (2006.01)
*H01R 13/62* (2006.01)
(Continued)

(52) U.S. Cl.
CPC ..... *H01R 13/6691* (2013.01); *H01R 13/6205* (2013.01); *H01R 13/70* (2013.01);
(Continued)

(58) Field of Classification Search
CPC ..... H01R 13/6691; H01R 13/516; H01R 13/6594; H01R 13/6275; H01R 13/70;
(Continued)

(56) References Cited

U.S. PATENT DOCUMENTS 6,632,103 B1 10/2003 Liu
7,311,526 B2 12/2007 Rohrbach
(Continued)

FOREIGN PATENT DOCUMENTS

CN 201365327 12/2009
CN 102664331 9/2012
(Continued)

OTHER PUBLICATIONS

International Search Report and Written Opinion received in PCT Application No. PCT/US2012/060767, dated Apr. 26, 2013, 11 pg.
(Continued)

*Primary Examiner* — Jean F Duverne
(74) *Attorney, Agent, or Firm* — Trop, Pruner & Hu, P.C.

(57) ABSTRACT

In some examples, a sink device includes a port comprising a power contact and data contacts, the port having a profile to engage with a flat connector in any of plural orientations of the flat connector, where the data contacts are to electrically connect to data contacts of the flat connector. A switching circuit comprises switches to apply polarity processing to signals corresponding to the data contacts to produce output data signals at a target data polarity regardless of the orientation of the flat connector when connected to the port.

17 Claims, 5 Drawing Sheets

(51) Int. Cl.

| | |
|---|---|
| ***H01R 29/00*** | (2006.01) |
| ***H01R 13/70*** | (2006.01) |
| *H01R 103/00* | (2006.01) |
| *H01R 13/64* | (2006.01) |

(52) U.S. Cl.
CPC ..... *H01R 29/00* (2013.01); *H01R 13/64* (2013.01); *H01R 2103/00* (2013.01)

(58) Field of Classification Search
CPC ..... H01R 29/00; H01R 43/18; H01R 12/592; H01R 12/79; H01R 13/6205; H01R 2103/00
USPC ..... 439/620.21
See application file for complete search history.

(56) References Cited

U.S. PATENT DOCUMENTS

| | | | | |
|---|---|---|---|---|
| 7,329,128 | B1 | 2/2008 | Awad | |
| 7,439,821 | B2 | 10/2008 | Schulman et al. | |
| 7,740,498 | B1 * | 6/2010 | Orsley | H01R 12/79 439/218 |
| 7,786,709 | B2 | 8/2010 | Lawson et al. | |
| 8,596,881 | B2 | 12/2013 | Umeno | |
| 9,106,031 | B2 * | 8/2015 | Golko | H01R 13/516 |
| 2003/0016509 | A1 * | 1/2003 | Tsukamoto | H01R 12/592 361/760 |
| 2007/0072442 | A1 | 3/2007 | DiFonzo et al. | |
| 2007/0105415 | A1 | 5/2007 | Yucheng et al. | |
| 2008/0164934 | A1 | 7/2008 | Hankey et al. | |
| 2008/0309313 | A1 * | 12/2008 | Farrar | G06F 1/266 323/351 |
| 2010/0080563 | A1 | 4/2010 | Difonzo | |
| 2013/0075149 | A1 * | 3/2013 | Golko | H01R 13/516 174/359 |
| 2014/0004741 | A1 * | 1/2014 | Jol | H01R 29/00 439/620.01 |
| 2014/0068933 | A1 * | 3/2014 | Brickner | B24B 41/06 29/874 |
| 2014/0073170 | A1 * | 3/2014 | Golko | H01R 13/6275 439/350 |
| 2014/0073183 | A1 * | 3/2014 | Golko | H01R 13/6594 439/607.34 |
| 2014/0206209 | A1 * | 7/2014 | Kamei | H01R 24/60 439/81 |
| 2014/0294656 | A1 * | 10/2014 | Brickner | H01R 43/18 419/28 |
| 2014/0329416 | A1 * | 11/2014 | Golko | H01R 29/00 439/676 |

FOREIGN PATENT DOCUMENTS

| | | | |
|---|---|---|---|
| JP | H09-298076 | A | 11/1997 |
| JP | 11285148 | A | 10/1999 |
| JP | 2002324637 | A | 11/2002 |
| KR | 10-2003-0051027 | A | 6/2003 |

OTHER PUBLICATIONS

Joshua Goldman, www.cnet.com/news/apples-lightning-connector-and-you-what-you-should-know/ Apple's Lightning connector and you: What you should know, Sep. 19, 2012 (4 pages).
Wang, et al; "The Scattering Parameters and Equivalent Networks of the Asymmetric Coupled Lines in Inhomogeneous Medium," pp. 201-204, Feb. 2000.
Wikipedia, Diode Bridge dated on or before Sep. 2012 (8 pages).

* cited by examiner

POLARITY CONTROL FOR A FLAT CONNECTOR

CROSS-REFERENCE TO RELATED APPLICATIONS

This is a continuation of U.S. application Ser. No. 14/434,177, filed Apr. 8, 2015, which is a national stage application under 35 U.S.C. § 371 of PCT/US2012/060767, filed Oct. 18, 2012, which are both hereby incorporated by reference in their entirety.

BACKGROUND

Power connectors for electronic devices can include coaxial connectors. A coaxial connector can be connected to a power port of an electronic device to supply power to the electronic device. A coaxial connector has an inner conductor surrounded by a generally cylindrical conductive shield. The inner conductor can provide a power voltage, while the conductive shield can provide a ground reference. When connecting a coaxial connector to a corresponding port of an electronic device, a user does not have to be concerned with the orientation of the coaxial connector, due to the concentric arrangement of the inner conductor and the conductive shield.

More recently, as electronic devices (such as computers, tablets, smartphones, etc.) have become thinner, flat connectors are increasingly being used to connect an electronic device to a power source. A flat connector has a relatively flat profile (e.g. rectangular profile, oval profile, etc.) to allow the flat connector to fit within the relatively thin profile of some electronic devices.

BRIEF DESCRIPTION OF THE DRAWINGS

Some embodiments are described with respect to the following figures.

DETAILED DESCRIPTION

A flat connector can be used to connect a power source to a sink device, which can be any device that consumes power. Examples of sink devices include computers, tablet devices, smartphones, personal digital assistants (PDAs), game appliances, power tools, telephones, and so forth. A flat connector can include a power contact and a reference contact (e.g. a ground contact) that are configured to electrically connect to respective contacts of a port on the sink device. The power contact of a flat connector is configured to carry a power voltage. The ground contact is configured to be connected to a ground reference. In the ensuing discussion, reference is made to a flat connector that has a power contact and a ground contact—in other examples, instead of a ground contact connected to a ground reference, a reference contact connected to a reference voltage can be used in the flat connector.

A "port" of a sink device can refer to a connecting structure that is able to engage with a flat connector, such that both mechanical and electrical connections can be provided between the flat connector and the port.

In a flat connector, the power contact and the ground contact are placed side by side, such that the power contact and the ground contact are laterally spaced apart from each other along just one direction. This arrangement of power and ground contacts in a flat connector is in contrast with a coaxial connector in which one contact is surrounded by another contact (e.g. cylindrical shield) in many directions. By placing the power contact and ground contact side by side, the flat connector (a non-coaxial connector) can achieve a relatively flat profile, where the height of the flat connector is much smaller than the width of the flat connector. Similarly, the port that is engageable with the flat connector is a non-coaxial port.

An issue associated with the use of a flat connector is that the power contact and the ground contact have a specific polarity with respect to each other. As a result, if the flat connector is engaged in a sink device port in a first orientation, then the power contact and ground contact of the flat connector are connected to respective contacts of the port at a first polarity. However, if the flat connector were to be flipped to a different orientation (such as upside down from the first orientation) when engaged with the port of the sink device, then the power contact and ground contact of the flat connector are connected to the respective contacts of the port at a second, opposite polarity. If appropriate mechanisms are not provided, connecting power and ground contacts in the wrong polarity to supply DC power to a port of a sink device can cause malfunction of the sink device.

Figure 1:
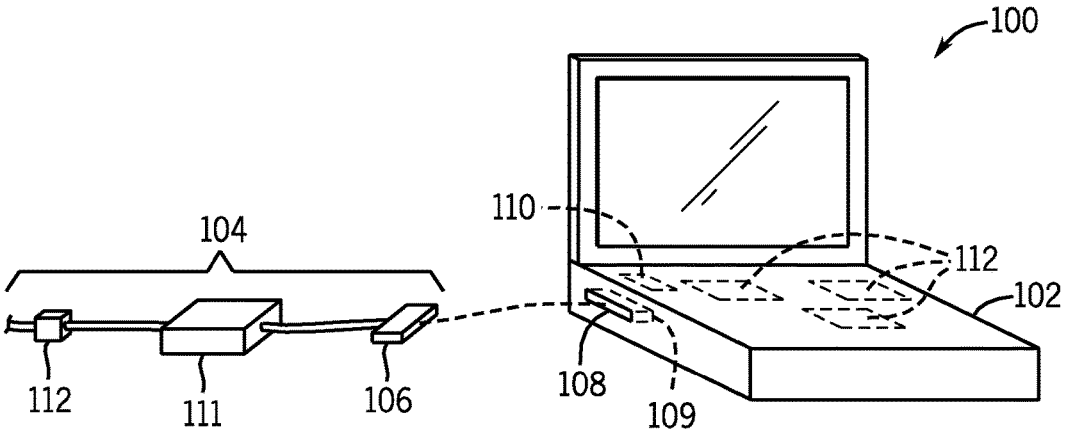
FIG. 1 is a schematic diagram of an example arrangement that includes a sink device and a power adaptor, in accordance with some implementations.

FIG. 1 illustrates an example system 100 that includes an electronic device 102 and a power adaptor 104. In the example of FIG. 1, the electronic device 102 is a notebook computer. In other examples, the electronic device 102 can be another type of sink device that has components 112 to consume power supplied by the power adaptor 104.

The electronic device 102 has a port 108 to receive a respective flat connector 106 of the power adaptor 104. A magnet 109 can be adjacent the port 108 in the electronic device 102 to magnetically attract the flat connector 106 to the port 108 to allow for more convenient engagement.

The power adaptor 104 further includes a main unit 111 that includes a power converter to convert between AC power and DC power. The power adaptor 104 has a plug 112 that is connected to the main unit 111. The plug 112 is configured to be inserted into a power receptacle, such as a wall receptacle. In other examples, the power adaptor 104 can be connected to another type of power source, including a DC power source.

In yet further alternative examples, the flat connector 106 can be part of a device different from the power adaptor 104.

The flat connector 106 can be connected to the port 108 in one of multiple different orientations of the flat connector 106. As noted above, the different orientations of the flat connector 106 can cause the polarities of the power and ground contacts of the flat connector 106 to be different. To address such issue, the electronic device 102 includes a polarity control circuit 110 that is connected to the port 108.

The polarity control circuit 110 can receive signals corresponding to the power and ground contacts of the flat connector 106 when the flat connector 106 is engaged with the port 108. The polarity control circuit 110 applies polarity processing to the signals corresponding to the power and ground contacts such that the polarity control circuit can produce output power signals (in the electronic device 102 for powering the components 112 of the electronic device 102) having a target polarity (the correct polarity) regardless of the orientation of the flat connector 106 when engaged in the port 108. Stated differently, the polarity control circuit 110 produces output power signals having the same target polarity regardless of whether the flat connector 106 has a first orientation or an opposite orientation when connected to the port 108.

The target polarity or the correct polarity of the output power signals from the polarity control circuit 110 refers to the polarity of the power signals that is expected by the components 112 that consume power supplied by the power adaptor 104. Using the polarity control circuit 108 according to some implementations, a user does not have to be concerned with the specific orientation of the flat connector 106 when connecting the flat connector 106 to the port 108.

Figure 2:
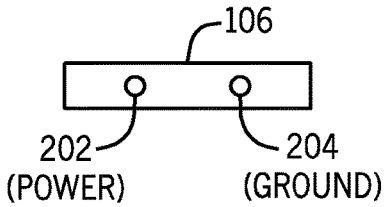
FIG. 2 is a schematic diagram of a flat connector according to some implementations.

FIG. 2 depicts a power contact 202 and a ground contact 204 of the flat connector 106. Although reference is made in the ensuing discussion to the ground contact 204, it is noted that the contact 204 can more generally be referred to as a reference contact 204 that is connected to a reference voltage. Collectively, the power contact 202 and ground contact 204 can be referred to as "power-related contacts." In the example of FIG. 2, the flat connector 106 has a relatively flat profile, which is depicted as being generally rectangular in shape. In other examples, the flat profile of the flat connector 106 can have curved edges, such as to provide an oval profile or other flat profile with curved edges. In yet other examples, the flat connector 106 can have profiles of other shapes. The flat connector 106 can be engaged with the port 108 regardless of whether the flat connector 106 is in a first orientation (as depicted in FIG. 2) or in a second orientation that is flipped from the first orientation.

In some examples, the flat connector 106 can include just a single power contact and a single ground contact, with no duplication of power and ground contacts provided in the flat connector 106. Avoiding duplication of power and ground contacts can allow the overall size of the flat connector 106 to be reduced. In other examples, the flat connector 106 can include additional power contact(s) and/or ground contact(s). Also, in further examples, the flat connector 106 can also include data contacts for communicating data signals, in addition to power signals communicated by the power and ground contacts.

Figure 3:
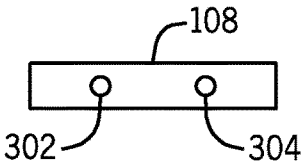
FIG. 3 is a schematic diagram of a port on a sink device for receiving a flat connector, in accordance with some implementations.

FIG. 3 depicts contacts 302 and 304 of the port 108 of the electronic device 102. The port 108 also has a generally flat profile that corresponds to the flat profile of the flat connector 106. The profile of the port 108 allows the flat connector 106 to be connected to the port 108 in either of two opposite orientations of the flat connector 106. The contacts 302 and 304 of the port 108 are placed side by side such that the connectors 302 and 304 are laterally spaced along just one direction. As seen in FIGS. 2 and 3, if the flat connector 106 has the orientation shown in FIG. 2 when connected to the port 108, then the contact 304 of the port 108 would be connected to the power contact 202, while the contact 302 of the port 108 would be connected to the ground contact 204. Such an engagement between the flat connector 106 and the port 108 results in a first polarity of the contacts 302 and 304, namely a polarity in which the contact 302 is at a ground reference and the contact 304 is at a power voltage.

If the flat connector 106 were to be flipped upside down from the orientation shown in FIG. 2 when connected to the port 108, then the port contact 304 would be connected to the ground contact 204, while the port contact 302 would be connected to the power contact 202 of the flat connector 106. This engagement would result in a second, opposite polarity of the contacts 302 and 304, where the port contact 302 is at the power voltage while the port contact 304 is at the ground reference.

Figure 4A:
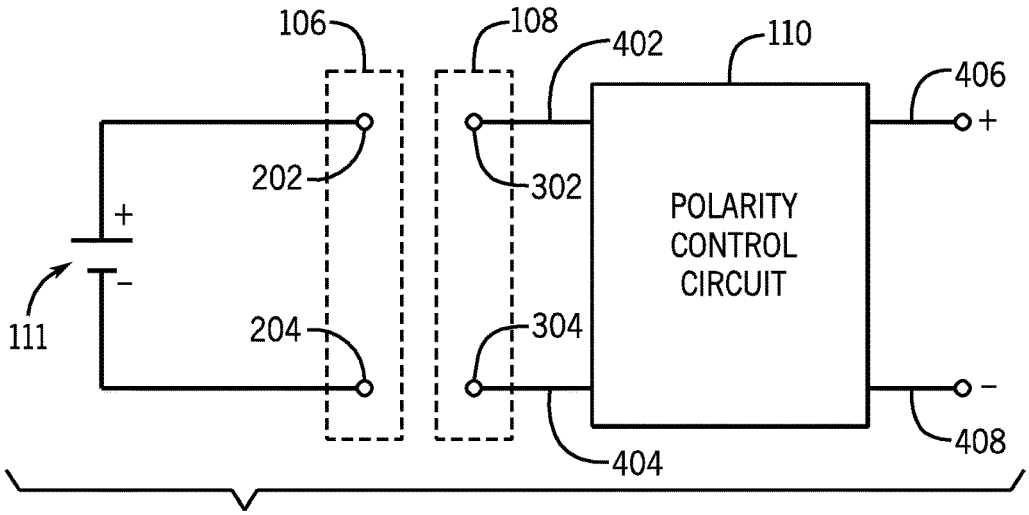
FIGS. 4A-4B are schematic diagrams of circuitry for producing power signals having a target polarity regardless of orientation of a flat connector, in accordance with some implementations.
Figure 4B:
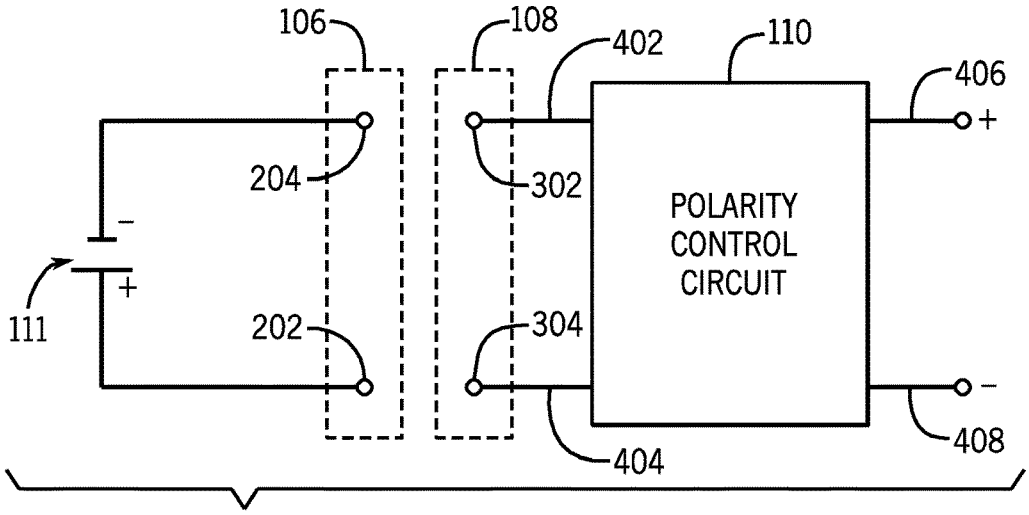

FIGS. 4A and 4B illustrate two different orientations of the flat connector 106 with respect to the port 108. In FIG. 4A, the flat connector 106 has a first orientation such that the flat connector power contact 202 is connected to the port contact 302, and the flat connector ground contact 204 is connected to the port contact 304. As further depicted in FIG. 4A, the output of the main unit 111 of the power adaptor 104 provides a power source having a positive (+) terminal and a negative (−) terminal, which are connected to the power contact 202 and ground contact 204, respectively.

Upon engagement of the flat connector 106 to the port 108 in FIG. 4A, the polarity control circuit 110 receives a first input signal 402 (connected to the port contact 302) at the power voltage, and a second input signal 404 (connected to the port contact 304) at the ground reference. The polarity control circuit 110 applies polarity processing to the received input signals 402 and 404, and produces output power signals 406 and 408 having a target polarity. In this target polarity, the output power signal 406 is at a power voltage and the output power signal 408 is at a ground resource.

In the FIG. 4B example, the flat connector 106 has been flipped to the opposite orientation, such that the flat connector ground contact 204 is connected to the port contact 302, and the flat connector power contact 202 is connected to the port contact 304. In this arrangement, the input signal 402 is at the ground reference, while the input signal 404 is at the power voltage. The input signals 402 and 404 in FIG. 4B have a polarity that is the opposite of the polarity of the input signals 402 and 404 in FIG. 4A. However, even with the input signals 402 and 404 flipped in polarity in FIG. 4B, the polarity control circuit 110 can apply polarity processing to produce output power signals 406 and 408 having the same target polarity as that in the example of FIG. 4A.

Figure 5:
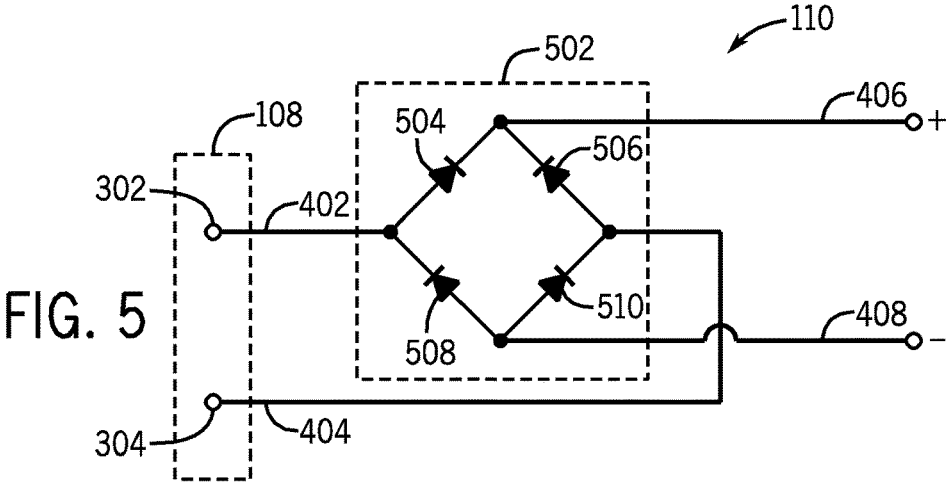
FIG. 5 is a schematic diagram of a full-wave bridge rectifier that can be used in a polarity control circuit according to some implementations.

FIG. 5 illustrates an example circuit that can be part of the polarity control circuit 110. In some implementations, the polarity control circuit 110 can include a full-wave rectifier 502, to apply full-wave rectification on the input signals 402 and 404 from the port contacts 302 and 304. The full-wave rectifier 502 generates the output power signals 406 and 408. The output power signal 406 from the full-wave rectifier 502 is at the power voltage, and the output power signal 408 from the rectifier 502 is at the ground reference, regardless of the polarity of the input signals 402 and 404. Stated differently, the polarity of the output power signals 406 and 408 is the same regardless of whether the input signals 402 and 404 are at a first polarity or at a second, opposite polarity.

In some examples, the full-wave rectifier can be implemented using a diode bridge including diodes 504, 506, 508, and 510 connected in a bridge arrangement, as shown. In other examples, another type of full-wave rectifier 502 can be employed.

The foregoing discussion provides examples in which the flat connector 106 has just one power contact and one ground contact. In other examples, the flat connector 106 can include additional power contacts and ground contacts. Moreover, in further examples, the flat connector 106 can also include data contacts for carrying data signals.

Figure 6:
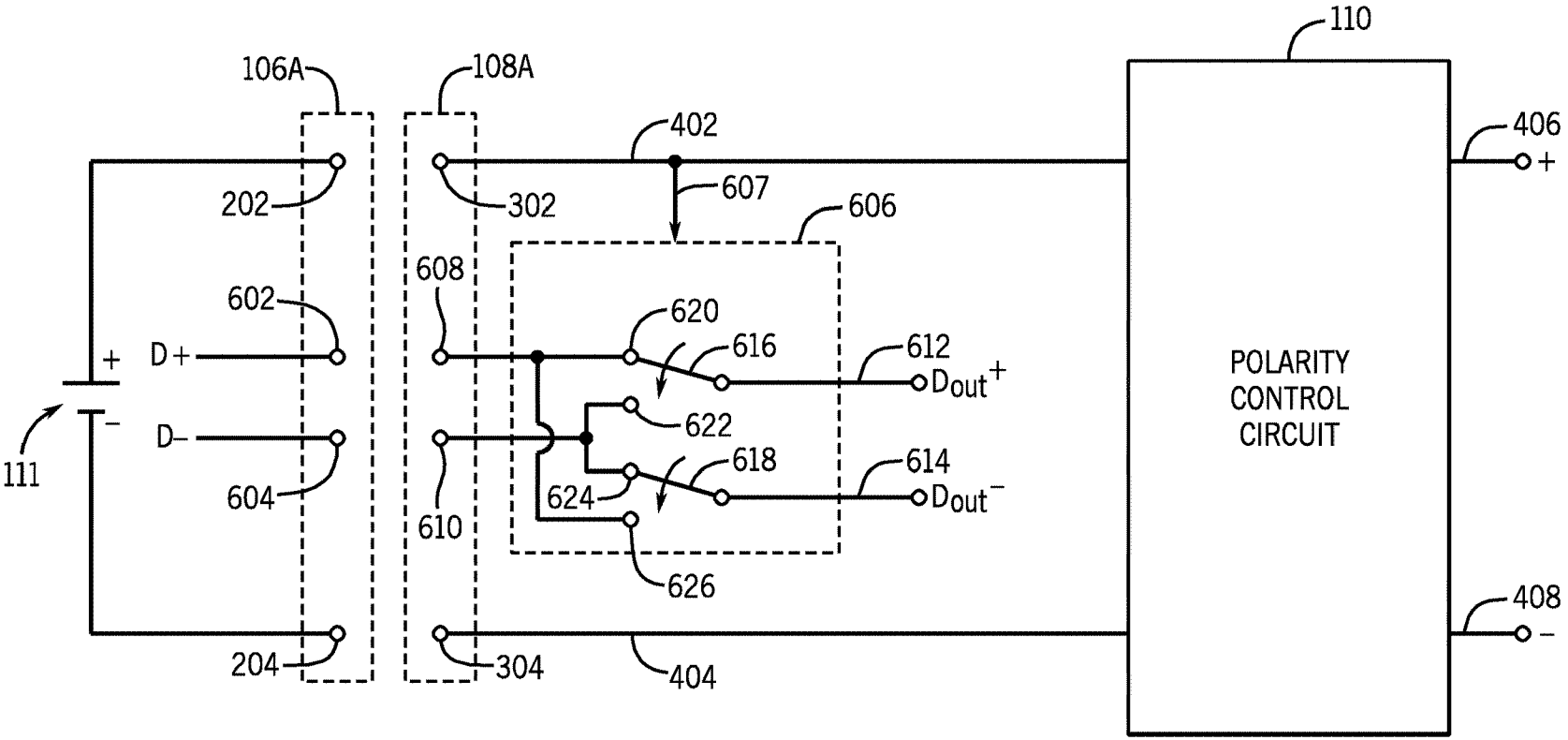
FIGS. 6 and 7 are schematic diagrams of circuitry for producing power signals and data signals having correct polarities regardless of the orientation of a flat connector when connected to a sink device port, in accordance with various implementations.

An example flat connector 106A having data contacts 602 and 604 along with the power contact 202 and ground contact 204 is depicted in FIG. 6. In FIG. 6, a port 108A of the electronic device 102 is configured to be connected to the flat connector 106A. The port 108A includes the port contacts 302 and 304 (for connection to the power and ground contacts 202 and 204) as well as port data contacts 608 and 610 that are to be connected to respective data contacts 602 and 604 of the flat connector 106A.

In the example of FIG. 6, it is assumed that the data contact 602 is connected to a first data signal (D+) and the data contact 604 is connected to a second data signal (D−). The data signals D+ and D− can make up a signal pair. Changing the orientation of the flat connector 106A when engaging the port 108A can cause the polarity of the data signal pair (D+, D−) at the port contacts 608 and 610 to change.

To address the foregoing issue, a switching circuit 606 is provided, which receives input data signals from the port data contacts 608 and 610. The switching circuit 606 is able to detect the orientation of the flat connector 106A relative to the port 108A, and based on the detected orientation, the switching circuit 606 is able to adjust positions of switches 616 and 618 in the switching circuit 606 to produce output data signals 612 and 614 (Dout+, Dout−) having a target data polarity. The switching circuit 606 is thus able to apply polarity processing to produce the output data signals 612 and 614 having the same target data polarity regardless of the orientation of the flat connector 106A when connected to the port 108A.

In some examples, the detection of the orientation of the flat connector 106A relative to the port 108A is based on the voltage of the input power signal 402. The switching circuit 606 has a control input 607 that is connected to the input power signal 402. If the input power signal 402 is at the power voltage, then that indicates a first orientation of the flat connector 106A. On the other hand, if the input power signal 402 is at the ground reference, then that indicates a reverse orientation of the flat connector 106A.

The state of the control input 607 of the switching circuit 606 controls the position of the switches 616 and 618 in the switching circuit 606. The switch 616 selectively connects the output data signal 612 to either a pin 620 (which is connected to the port data contact 608), or a pin 622 (which is connected to the port data contact 610).

Similarly, the switch 618 selectively connects the output data signal 614 to either a pin 624 (which is connected to the port data contact 610) or to the pin 626 (which is connected to the port data contact 608).

If the input power signal 402 is at the power voltage, then the switch 616 is activated to connect to pin 620, while the switch 618 is activated to connect to pin 624. On the other hand, if the input power signal 402 is at the ground reference, then the switch 616 is activated to connect to the pin 622, and the switch 618 is activated to connect to the pin 626.

In alternative implementations, the input power signal 404 can be connected to the control input 607 of the switching circuit 606 to control positions of the switches 616 and 618.

The arrangement of FIG. 6 may also include the polarity control circuit 110 (similar to that depicted in FIG. 4A) to apply polarity processing to the input power signals 402 and 404 to produce the output power signals 406 and 408 having the target polarity.

Figure 7:
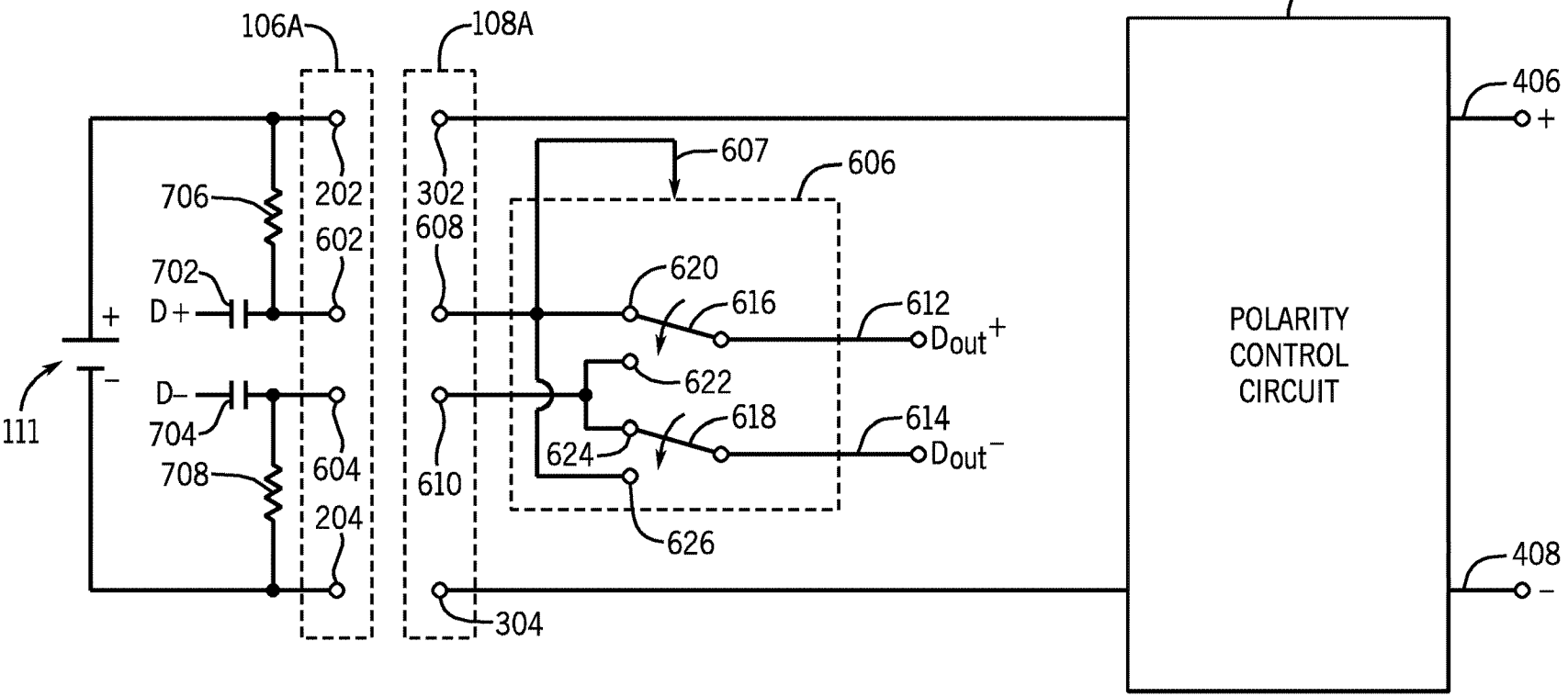

FIG. 7 illustrates a different example arrangement that is a variation of the arrangement of FIG. 6. The arrangement of FIG. 7 also includes the switching circuit 606 as well as the polarity control circuit 110.

In the example of FIG. 7, the data signals D+ and D− are capacitively coupled to the data contacts 602 and 604 of the flat connector 106A through corresponding capacitors 702 and 704. In addition, the D+ contact 602 is coupled to the positive terminal of the power source (main unit 111) through a bias resistor 706, while the D− contact 604 is coupled to the negative terminal of the power source through a bias resistor 708. In the example of FIG. 7, the control input 607 to the switching circuit 606 is connected to the port data pin 608 of the port 108A. Selective activation of the switches 616 and 618 in the switching circuit 606 is controlled by a voltage level of the port data pin 608, which is pulled to the voltage of the flat connector data pin 602 when the flat connector 106A is engaged with the port 108A.

In different implementations, the control input 607 to the switching circuit 606 can be connected to the port data contact 610. In either the arrangement of FIG. 6 or 7, the polarity processing applied to input data signals to produce output data signals having the correct polarity is based on a detected state of a power-related contact (202 or 204) of the flat connector 106A.

Note that the flat connector data pin 602 is biased to the power voltage of the positive terminal of the power source through the bias resistor 706. Similarly, the flat connector data pin 604 is biased to the ground reference provided by the negative terminal of the power source through the bias resistor 708. Variations in the data signals D+ and D− are capacitively coupled to the flat connector data contacts 602 and 604.

Note that the switching circuit 606 depicted in FIG. 6 or 7 provides a functional representation of the switching circuit. In some implementations, the switching circuit 606 can be part of a device that is separate from a chipset of an electronic device. In other implementations, the switching circuit 606 can be implemented within an integrated circuit chip that is to use the received data. Alternatively, the data inversion provided by the chipset can be based on bus polarity inversion according to some bus standards, such as PCI-E (Peripheral Component Interconnect Express) or other standards. With either of the foregoing implementations, the data polarity inversion is based on the state of the input power signal 402 (FIG. 6) or the state of the port data pin 608 (FIG. 7), as examples.

Figure 8:
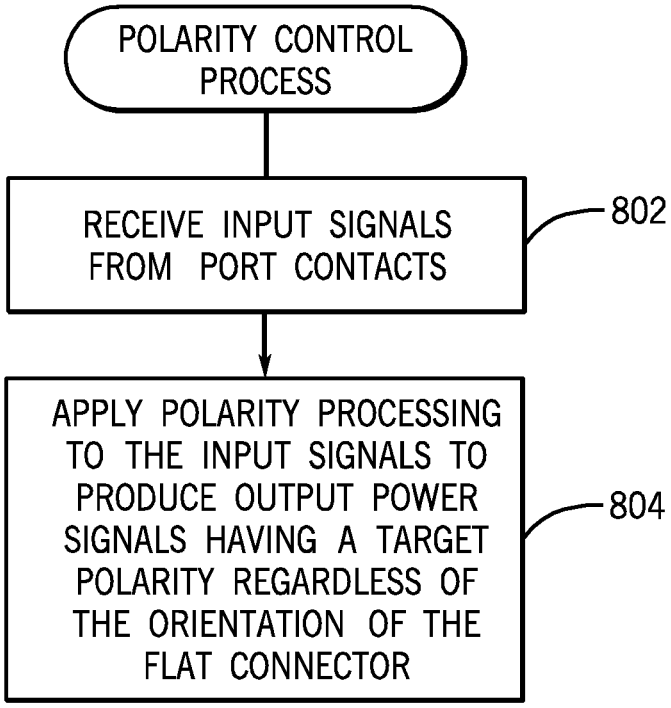
FIG. 8 is a flow diagram of a process performed by a polarity control circuit according to some implementations.

FIG. 8 illustrates a flow diagram of a process according to some implementations. The process can be performed by circuitry (e.g. polarity control circuit 110) of a sink device (e.g. electronic device 102 in FIG. 1) to produce output power signals having a target polarity regardless of an orientation of a flat connector when connected to a port of the sink device. The polarity control circuit receives (at 802) input signals from port contacts when the port is engaged with the flat connector. The polarity control circuit applies (at 804) polarity processing to the input signals to produce output power signals having a target polarity regardless of the orientation of the flat connector when engaged to the port.

In the foregoing description, numerous details are set forth to provide an understanding of the subject disclosed herein. However, implementations may be practiced without some or all of these details. Other implementations may include modifications and variations from the details discussed above. It is intended that the appended claims cover such modifications and variations.

What is claimed is:

1. An electronic device comprising:

a port engageable with a flat connector in any of plural orientations of the flat connector, the port comprising a power contact and data contacts, the power contact to engage a respective contact of the flat connector when the port and the flat connector are engaged; and a switching circuit comprising switches to:

receive input signals from the data contacts of the port when the port is engaged with the flat connector, wherein the switches are controllable by an input power signal from the power contact of the port when the port and the flat connector are engaged, and apply polarity processing to the input signals to produce output data signals at a target polarity regardless of the orientation of the flat connector when engaged to the port, wherein the polarity processing is based on detecting a state of the power contact of the port.

2. The electronic device of claim 1, wherein the power contact of the port is to engage a power contact or a reference contact of the flat connector depending on a relative orientation of the port and the flat connector.

3. The electronic device of claim 2, wherein the power contact of the port is to engage the power contact of the flat connector when the port and the flat connector are engaged in a first orientation.

4. The electronic device of claim 3, wherein the power contact of the port is to engage the reference contact of the flat connector when the port and the flat connector are engaged in a second orientation.

5. The electronic device of claim 2, wherein the input power signal when connected to the power contact of the flat connector is to set the switches in first positions, and the input power signal when connected to the reference contact of the flat connector is to set the switches in second positions different from the first positions.

6. The electronic device of claim 1, wherein the data contacts provide a positive data signal and a negative data signal that make up a signal pair.

7. The electronic device of claim 1, wherein the port further comprises a reference contact, the power and reference contacts to engage power and reference contacts of the flat connector.

8. The electronic device of claim 1, wherein the data contacts are laterally spaced from one another in just one direction.

9. The electronic device of claim 1, wherein the port is a non-coaxial port.

10. The electronic device of claim 1, further comprising a magnet to magnetically attract the flat connector to the port for engaging the flat connector to the port.

11. A sink device comprising:

a port comprising a power contact and data contacts, the port having a profile to engage with a flat connector in any of plural orientations of the flat connector, wherein the data contacts are to electrically connect to data contacts of the flat connector;

a switching circuit comprising switches to apply polarity processing to signals corresponding to the data contacts of the port to produce output data signals at a target data polarity regardless of the orientation of the flat connector when connected to the port, wherein the switches are to selectively connect the output data signals to the signals corresponding to the data contacts of the port in a first arrangement in response to detecting a first orientation of the flat connector, and to connect the output data signals to the signals corresponding to the data contacts of the port in a second, different arrangement in response to detecting a second, different orientation of the flat connector, and wherein the switches are controllable by a signal from the power contact of the port.

12. The sink device of claim 11, wherein the signal has a first state in response to the port being engaged with the flat connector in the first orientation, and the signal has a second state in response to the port being engaged with the flat connector in the second orientation.

13. The sink device of claim 12, wherein the signal having the first state causes the switches to be set at first positions, and the signal having the second state causes the switches to be set at second positions different from the first positions.

14. A system comprising:

a power adapter comprising a flat connector including a power contact, a positive data contact, and a negative data contact;

a sink device comprising a port engageable with the flat connector in any of plural orientations of the flat connector; and switches controllable by an input power signal, the input power signal having a first state when the port is engaged with the flat connector in a first orientation, the input power signal having the first state to set the switches to first positions, the input power signal having a second state when the port is engaged with the flat connector in a second orientation, the input power signal having the second state to set the switches to second positions different from the first positions, the switches to receive input data signals connected to the positive and negative data contacts, the switches to provide output data signals at a target data polarity regardless of an orientation of the flat connector when engaged with the port of the sink device.

15. The system of claim 14, wherein the flat connector further includes a reference contact, the input power signal when connected to the power contact to set the switches to the first positions, and the input power signal when connected to the reference contact to set the switches to the second positions.

16. The system of claim 14, wherein the positive data contact and the negative data contact together make up a signal pair, and wherein the port has a first data contact and a second data contact that connect respectively to the positive data contact and the negative data contact of the flat connector when the flat connector is engaged to the port in the first orientation, and the first data contact and second data contact connect respectively to the negative data contact and the positive data contact of the flat connector when the flat connector is engaged to the port in second orientation.

17. The system of claim 16, wherein the switches when set to the first positions connect a first of the output data signals to the first data contact and a second of the output data signals to the second data contact, and the switches when set to the second positions connect the first output data signal to the second data contact and the second output data signal to the first data contact.

* * * * *